US005720334A

United States Patent [19]

Usui et al.

[11] Patent Number: 5,720,334

[45] Date of Patent: Feb. 24, 1998

[54] CASTING DEVICE FOR PRODUCING CLOSED DECK TYPE CYLINDER BLOCK AND SAND CORE USED IN THE DEVICE

[75] Inventors: Hirotake Usui; Yasuyuki Mizukusa; Tatsuya Manabe, all of Fuchu, Japan

[73] Assignee: Ryobi Ltd., Hiroshima-Ken, Japan

[21] Appl. No.: 797,314

[22] Filed: Feb. 7, 1997

[30] Foreign Application Priority Data

| | | | |
|---|---|---|---|
| Feb. 9, 1996 | [JP] | Japan | 8-048378 |
| Jul. 19, 1996 | [JP] | Japan | 8-208800 |

[51] Int. Cl.[6] ..... B22D 34/04

[52] U.S. Cl. ..... 164/340; 164/137

[58] Field of Search ..... 164/340, 333, 164/98, 137

[56] References Cited

U.S. PATENT DOCUMENTS

| | | | |
|---|---|---|---|
| 4,462,455 | 7/1984 | Henych et al. | 164/340 |

FOREIGN PATENT DOCUMENTS

| | | |
|---|---|---|
| 0 465 947 | 1/1992 | European Pat. Off. . |
| 0 585 136 | 3/1994 | European Pat. Off. . |
| 1-178361 | 7/1989 | Japan . |
| 3-184654 | 8/1991 | Japan . |
| 2 068 801 | 8/1981 | United Kingdom . |
| 91/00787 | 1/1991 | WIPO . |

OTHER PUBLICATIONS

Patent Abstracts Of Japan, vol. 013, No. 458 (M-880), Oct. 17, 1989, & JP 01 178361 A (RYboi Ltd), Jul. 14, 1989, *Abstract.

*Primary Examiner*—Kuang Y. Lin

*Attorney, Agent, or Firm*—Sughrue, Mion, Zinn, Macpeak & Seas, PLLC

[57] ABSTRACT

A combination of a device for producing a closed deck type cylinder block and a sand core to be used in the device, the combination being capable of producing the block having high dimensional accuracy and eliminating precise dimensional control to the end face portion of the sand core. The sand core has a configuration identical with a water jacket formed in the engine block. Holding projections extending in an axial direction of a cylinder liner integrally protrude from a slide core of a movable die, and complementary holding bores are formed in the sand core, the bores being open at a top deck end face of the sand core. In one preferred embodiment, the top deck end face of the sand core is of a planner arrangement, and an end face of the slide core is formed with recesses for forming bridge portions therein. Casting is performed while maintaining a surface contact between the planner end face and the end face of the slide core. The contacting areas will become windows of the water jacket.

8 Claims, 6 Drawing Sheets

CASTING DEVICE FOR PRODUCING CLOSED DECK TYPE CYLINDER BLOCK AND SAND CORE USED IN THE DEVICE

BACKGROUND OF THE INVENTION

The present invention relates to a casting device for producing a closed deck type cylinder block and a sand core used in the casting device, and more particularly, to a combination of the casting device and the sand core, the combination being capable of performing casting operation while properly holding the sand core in the casting device.

A closed deck type cylinder block is known in which bridge portions are provided bridging between a top deck of a cylinder head and outer end portions of cylinders in order to reduce engine vibration and to reinforce the cylinder block. In this type of the cylinder block, an upper open end of a water jacket is partly covered with the bridge portions. In other words, the upper open end of the water jacket constitutes windows each sectioned by the bridge portion. Thus, an undercut is provided in the water jacket below the bridge portions. Therefore, a sand core must be set at a position corresponding to the water jacket and the sand core must be collapsed after casting so as to remove the sand from the water jacket. Further, during casting operation, the sand core must be properly held within a metal mold.

Japanese Patent Application Kokai(OPI) No.Hei 1-178361 discloses a method for holding a sand core within the metal mold in producing the closed deck type cylinder block. According to the method, a sand core 101 shown in FIG. 12 adapted for forming a water jacket which will surround three cylinders is provided with protruding portions 101*a* engageble with complementary recesses 102*a* formed in a slide core 102 shown in FIG. 13 in order to form windows at the engaging portions. A driving means (not shown) for driving holding pins 103 is provided independently of a driving means (not shown) adapted for driving a movable die toward and away from a stationary die (not shown). The holding pins 103 extends through the slide core 102 and projects into and retracts from a mold cavity by the holding pin drive means. The planer end face of the sand core 101 other than the protruding portions 101*a* is filled with a molten metal so as to produce the bridge portions at the end of the water jacket.

With this arrangement, the holding pins 103 project into the mold cavity, and the sand core 101 for forming the water jacket is temporarily mounted on the holding pins 103 as shown in FIG. 12. Then, the protruding portions 101*a* for forming the windows at the axially end portion of the sand core 101 are engaged with the complementary recesses 102*a* formed in the slide core 102, and at the same time, projections or core prints 101*b* projecting from the periphery of the sand core 101 are engaged with recessed portions (not shown) formed in the movable die so as to hold the sand core within the metal mold. Thereafter, the holding pins 103 are retracted from the mold cavity. By the projecting and retracting movement of the holding pins 103 relative to the mold cavity, the sand core 101 is held at a given position within the metal mold.

The sand core 101 is ultimately held in the metal mold by the engagement between the protruding portions 101*a* and the complementary recessed portions 102*a* and by the engagement between the projections 101*b* and the recesses. Accordingly, in order to enhance positional accuracy of the sand core 101, clearance between the protruding portions 101*a* and the complementary recesses 102*a* for forming windows should be reduced. However, reduction in the clearance incurs accurate dimensional control, which in turn increases production cost. More specifically, the sand core 101 is generally subjected to coating in order to prevent the molten metal from being entered into the sand core. However, the coating thickness may not be uniform, which may vary the clearance. Thus, adhesion amount of the coating agent over the protruding portions 101*a* must be precisely controlled.

Further, in producing the sand core, sand filling rate to the protruding portions 101*a* is inferior to that to the other part, and therefore, the protruding portions 101*a* provide insufficient mechanical strength and may be easily collapsed. Furthermore, the sand core is heated during casting and a binder contained therein may be burned by the heat, which causes reduction in strength of the sand core. The lowered strength is particularly actualized at the protruding portions 101*a* which may be easily collapsible. Moreover, if excessive local load is applied during take out of the casted product from the metal mold, the protruding portions 101*a* are collapsed, and sand remain at the complementary recessed portions 102*a*. If a subsequent sand core is set in the metal mold and the metal mold is closed while the residual sand remain at the recessed portions 102*a*, excessive force is applied to the sand core, so that the sand core may be collapsed prior to the casting. Consequently, sand remaining at the recessed portions 102*a* must be removed. However, it would be rather difficult to acknowledge the residual sand due to the blind space i.e., the recessed portions and cleaning work may be difficult due to the small concaved space of the recessed portions. Accordingly, productivity may be lowered. Furthermore, the casting device having the movable holding pins 103 is only available, otherwise the sand core cannot be set at a position within the metal mold.

SUMMARY OF THE INVENTION

It is therefore an object of the present invention to provide a combination of a casting device for producing a closed deck type cylinder block and a sand core to be used in the casting device, the combination being capable of accurately holding the sand core within a metal mold for producing the closed deck type cylinder block having high dimensional accuracy.

Another object of the present invention is to provide such combination capable of eliminating accurate dimensional control with respect to the protruding parts of the sand core for forming the windows.

Still another object of the present invention is to provide such combination in which residual sand can be easily acknowledged and removed at a sand core holding portion.

Still another object of the present invention is to provide such combination in which means for driving the above described holding pins can be dispensed with.

These and other objects of the present invention will be attained by a device for producing a closed deck type cylinder block and a sand core to be used in the device, the closed deck type cylinder block having a top deck and being formed with a water jacket surrounding a plurality of juxtaposedly arrayed cylinder liners, the water jacket having an upper end partly open at the top deck for forming windows and partly closed by bridge portions, the device comprising a metal mold defining therein a mold cavity, and a holding projection integrally extending from the metal mold toward the mold cavity in an axial direction of the cylinder liner. The sand core is formed with complementary holding bore which allows the holding projection to extend thereinto for holding the sand core at a predetermined position within the mold cavity during casting operation.

By the combination of the casting device and the sand core, the sand core can be properly held by the engagement between the holding projections provided integrally with the metal mold and the holding bores formed in the sand core. Therefore, it is unnecessary to perform conventional positioning by the engagement between the recesses formed in the metal mold and the protruding portions provided at the sand core. Thus, precise control to the clearance between the metal mold and the sand core, i.e., between the conventional recesses and protrusions, can be eliminated, yet improving positional accuracy of the sand core.

Further, because the sand core can be held by the protruding components protruding from the metal mold and the holding bores formed in the sand core, even if the sand is released from the sand core, the residual sand on the protruding components can be easily acknowledged, and cleaning for removing the residual sand can be easily performed, to thus enhance productivity.

DETAILED DESCRIPTION OF THE PREFERRED EMBODIMENTS

A casting device for casting a closed deck type cylinder block and a sand core used in the casting device according to a first embodiment of the present invention will be described with reference to FIGS. 1 through 6. The first embodiment is applied for casting a closed deck type cylinder block of a V-bank type six cylinder internal combustion engine.

Figure 1:
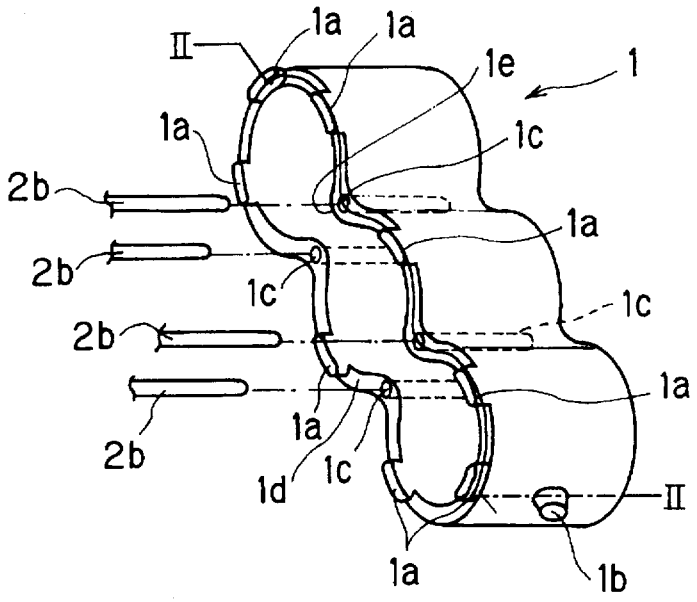
FIG. 1 is a perspective view showing a sand core according to a first embodiment of this invention for forming a water jacket, the core being used for casting a closed deck type cylinder block.
Figure 2:
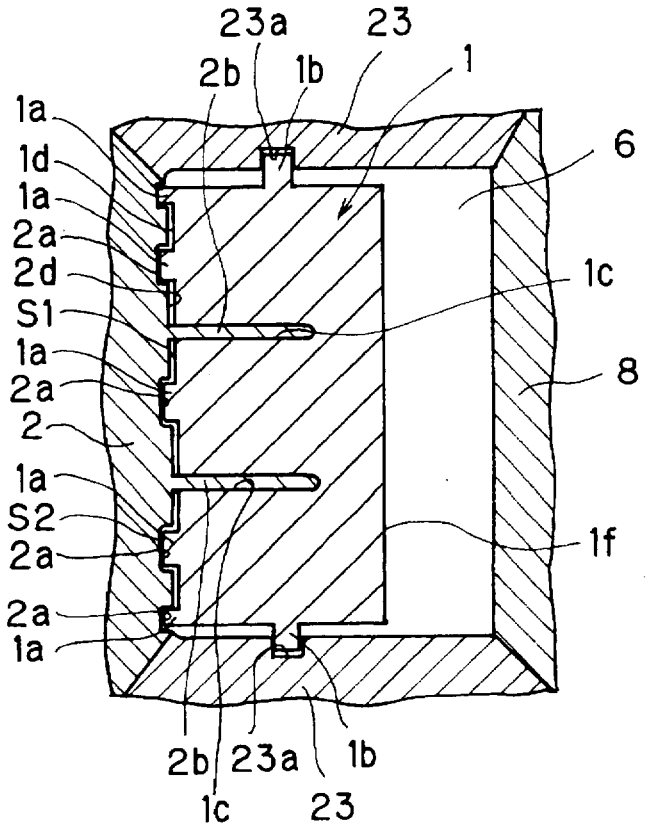
FIG. 2 is a cross-sectional view taken along the corrugated line II—II of FIG. 1, showing the sand core and a metal mold including a slide core in a casting device according to the first embodiment for casting the closed deck type cylinder block.
Figure 4:
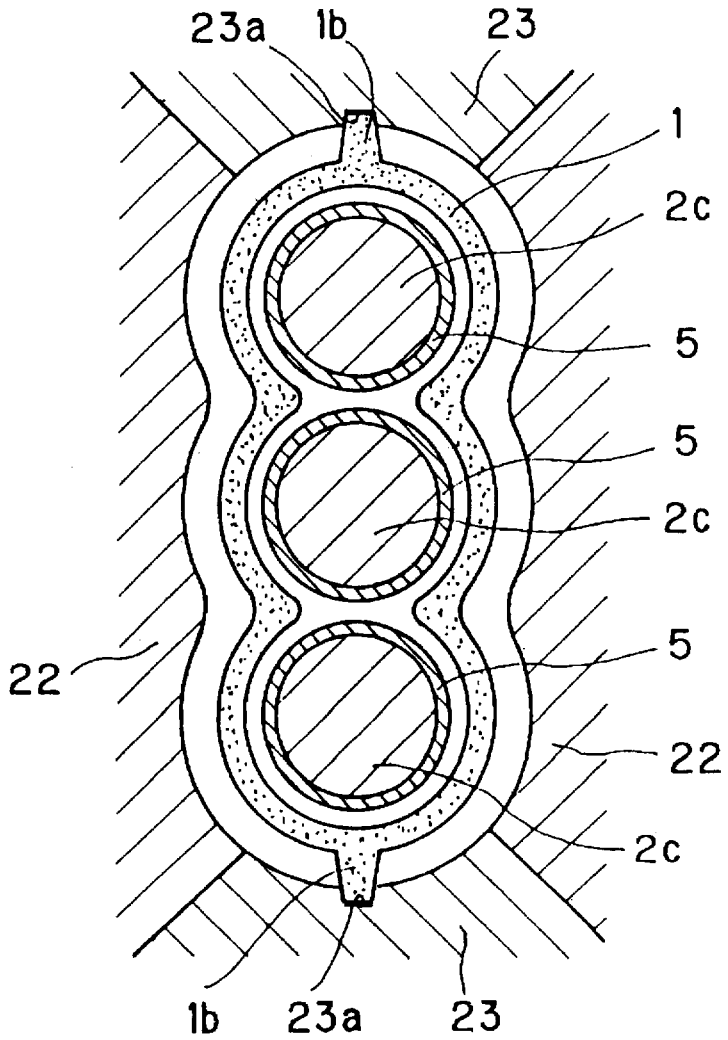
FIG. 4 is a cross-sectional view taken along the line IV—IV of FIG. 6 and showing the metal mold of the casting device and the sand core held in the casting device according to the first embodiment.

The sand core 1 shown in FIG. 1 is adapted for forming a water jacket surrounding three cylinders in the V-bank type six cylinder engine block. FIGS. 2 and 4 show a state in which the sand core 1 is set within a mold cavity 6. The mold cavity 6 is defined by a slide core 2, a stationary die 8, a pair of first slide cores 22,22 and a pair of second slide cores 23,23.

As shown in FIG. 2, a slide core 2 has a cavity face 2*d* defining a part of the mold cavity 6. The cavity face 2*d* is formed with recesses 2*a*. The sand core 1 has an end face 1*d* in confrontation with the cavity face 2*d*. The end face 1*d* is provided with protruding portion 1*a* insertable into the recesses 2*a* for forming windows at a top end of the water jacket. A space S1 is defined between the cavity face 2*d* and portions other than the protruding portions 1*a* of the end face 1*d*. During casting, molten metal is filled into the space S1 so that bridge portions are provided at the top end of the water jacket. In other words, in the top end of the water jacket, neighboring windows are sectioned by the bridge portion.

The pair of second slide cores 23,23 are formed with engaging holes 23*a*, 23*a*. Further, the sand core 1 is provided with a pair of core prints 1*b*,1*b* protruding from the periphery of the sand core 1. Each core print 1*b* is engageable with each engaging hole 23*a*, so that the sand core 1 is positioned in place in the mold cavity 6.

Figure 3:
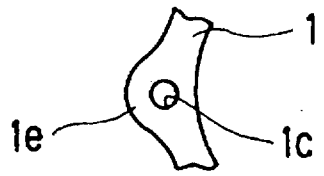
FIG. 3 is a plan view showing a part of the sand core, the part including a holding bore.

As shown in FIGS. 1 and 3, the sand core 1 has a thickened wall portions 1*e* at positions adjacent the neighboring cylinders, and holding bores 1*c* are formed from the end face 1*d* into the thickened wall portions 1*e* so as to allow holding projections 2*b* described later to extend into the holding bores 1*c*. Because the holding bores 1*c* are formed in the wall of the sand core 1 in an axial direction of the cylinder, the thickened walls 1*e* has a thickness greater than that of the remaining wall potion so as to sustain casing pressure. Incidentally, a reference numeral 1*f* designates a rear end surface of the sand core 1.

A clearance S2 between the protruding portions 1*a* of the sand core 1 and the recessed portions 2*a* of the slide core 2 is relatively large, for example from 0.5 to 1.0 mm. By providing the large clearance, the molten metal can be filled in the clearance S2 as a flash. Therefore, separated or residual sand in the recessed portions 2*a* can be removed together with the removal of the flash. Because positive flashing is contemplated in the first embodiment at the clearance S2, molten metal pressure is applied to both axial end faces of the sand core 1, i.e., left side and right side of the sand core 1 in FIG. 2. Accordingly, the core prints 1*b* and complementary engagement holes 23*a* are required so as to prevent the sand core 1 from being moved in the axial direction of the cylinder within the mold cavity 6.

Figure 5:
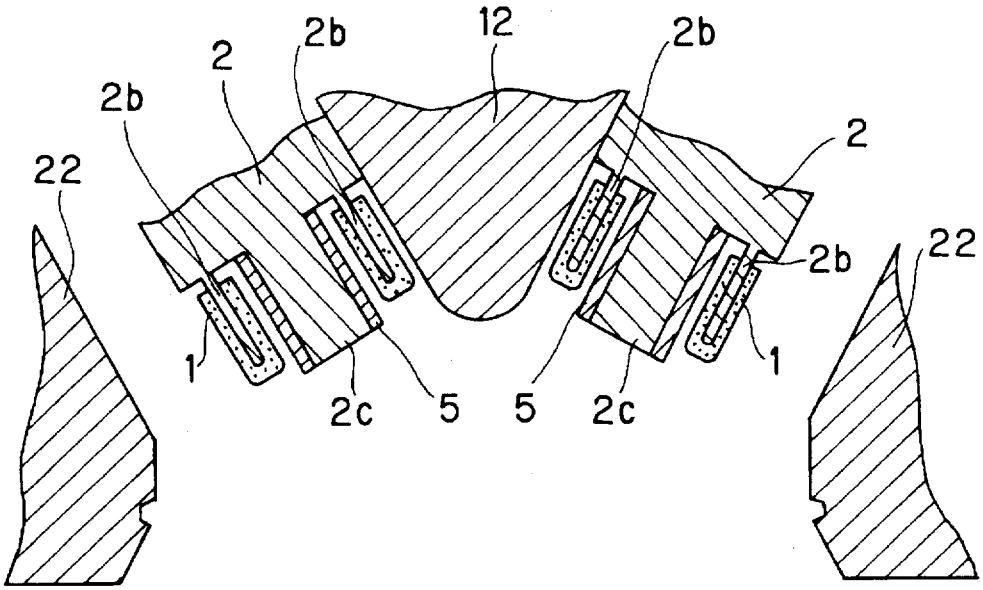
FIG. 5 is a cross-sectional view showing an open state of the metal mold in the casting device and the sand core according to the first embodiment.
Figure 6:
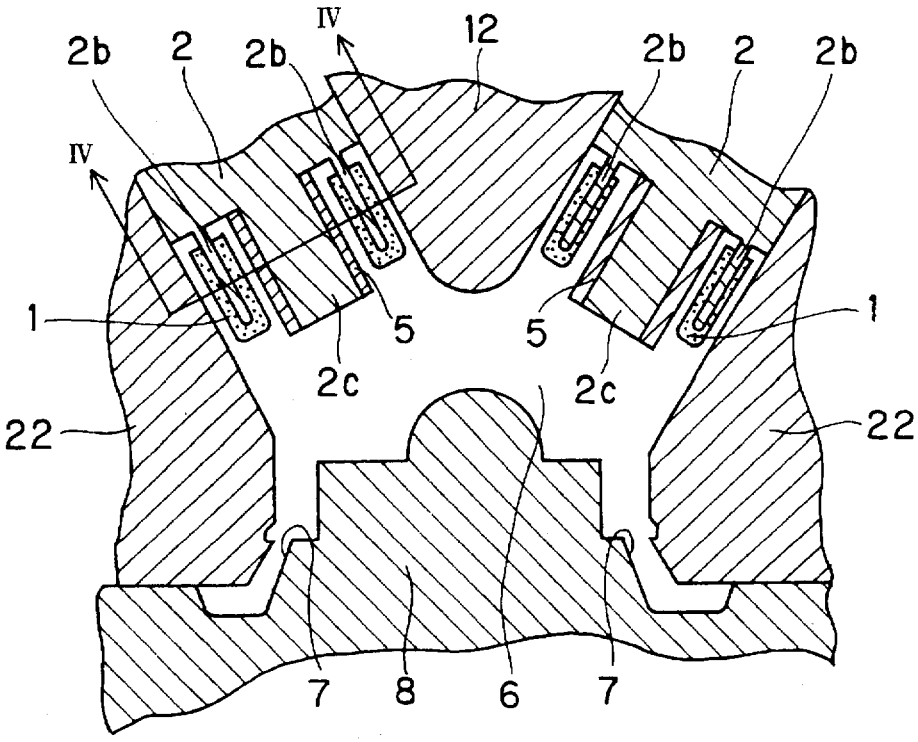
FIG. 6 is a cross-sectional view showing a closed state of the metal mold in the casting device and the sand core according to the first embodiment.

As shown in FIGS. 5 and 6, each slide core 2, 2 is disposed at both sides of a movable die 12. The above described first and second slide cores 22,22 and 23,23 are movably disposed beside the slide cores 2,2. A combination of the stationary die 8, the slide cores 2, 2, the first and second slide cores 22,22, and 23,23 and the movable die 12 defines an outer contour of the cylinder block for the V-bank type six cylinder engine. Each slide core 2 includes a cylindrical projection 2*c* around which a cylinder liner 5 is fittable. Further, sand core holding protrusions 2*b* protrude from the slide core 2 in the axial direction of the cylinder liner 5 toward the mold cavity 6. The protrusions 2*b* are provided integrally with the slide core 2, and has a circular cross-section. An outer diameter of each protrusion 2*b* is gradually reduced toward its tip so as to provide a draft which facilitates removal of the protrusion 2*b* from the holding bore 1*c* after casting. Similarly, cross-section of the holding bore 1*c* has a complementary tapered shape. Incidentally, in FIGS. 5 and 6, the cylinder liners 5 are supported by the cylindrical projection 2*c* such that each axis of the cylinder liner extends in a horizontal direction. Further, a runner 7 is provided for introducing the molten metal into the mold cavity 6.

With this arrangement, while maintaining opening state of the metal mold shown in FIG. 5, the holding projections 2*b* of the slide core 2 are engaged with the holding bores 1*c* of the sand core 1 so as to hole the sand core 1 to the slide core 2. After the cylinder liners 5 are fitted over the cylindrical projections 2*c* of the slide core 2, the first and second slide cores 22,22 and 23,23 are moved to move the entire movable die toward the stationary die 8 so as to define the mold cavity 6 shown in FIG. 6. Then, the molten metal is filled into the mold cavity 6 through the runner 7 for casting the cylinder block.

During casting, the sand core 1 is held by the holding protrusions 2*b*, and therefore, the sand core 1 can be positioned precisely within the mold cavity 6. Further, because of the engagement between the core prints 1*b* and recesses 23*a*, the sand core 1 can be held stationarily in the metal mold without any displacement in the axial direction of the cylinder liner 5 despite of the molten metal pressure. Further, since relatively large clearance S2 is provided between the protrusions 1*a* and the complementary recess 2*a* for forming the window, the flash can be formed in the clearance S2 during casting. Therefore, even if sand in the protrusion 1*a* is separated from the core 1, the separated sand can be removed from the recess 2*a* together with the flash at the time of removal of the casted product from the metal mold.

More specifically, the binder contained in the sand core 1 may be decomposed due to the heat of the molten metal to lower the strength of the sand core 1, and sand constituting the protrusion 1*a* may be released therefrom. However, the molten metal can be easily entered into the large space clearance S2 to form the flash. Thus, the outer portion of the protrusion 1*a* is surrounded by the flash. After casting, the metal mold is opened and the casted product is removed therefrom. In this case, the released sand can also be removed together with the flash. Accordingly, the sand do not remain in the recess 2*a*. Further, the casted product containing therein the sand core 1 is removed from the holding projection 2*b*, and sand may be affixed to the holding projection 2*b*. However, because the holding projection 2*b* is of the protruding construction, sand adhesion therearound can be easily acknowledged, and the sand can be easily removed therefrom.

Then, the sand core 1 is discharged from the casted product through the formed windows of the water jacket. Further, machining is effected so as to form a female thread at each dimpled portion of the casted product, each dimpled portion being corresponding to each core print 1*b*. Then, threaded plugs (not shown) are threadably engaged with the female threads so as to plug the dimples.

As described above, according to the first embodiment of the present invention, the holding projections 2*b* which belongs to the metal mold side, are inserted into the holding bores 1*c* which belongs to the sand core side to hold the sand core 1 in the metal mold, and the engagement between the protruding portions 1*a* and the recesses 2*a* does not serve to hold the sand core 1. Accordingly, large clearance S2 can be provided between the protruding portions 1*a* and the recess 2*a*. Consequently, even if the mechanical strength of the sand core is reduced due to the decomposition of the binders contained therein by the heat of the molten metal so that the part of sand at the protruding portion is released, the released sand can be removed from the recess when removing the flash provided at the large clearance S2. It should be noted that the flash is provided around the protruding portion and the flash can surely be provided because the molten metal can be easily entered into the large space S2.

Further, the sand core 1 is held by the engagement between the holding projection 2*b* protruding from the metal mold and the holding bore 1*c* formed in the sand core. Therefore, even if sand remains on the holding projection 2*b*, the remaining sand is easily visible because the holding projection 2*b* is of the projecting component. Thus, cleaning to the metal mold can be easily performed to enhance productivity.

A casting device for casting a closed deck type cylinder block and a sand core used in the casting device according to a second embodiment of the present invention will be described with reference to FIGS. 7 and 8. According to the first embodiment, in order to remove the residual sand in the recess 2*a* of the slide core 2, the clearance S2 is positively provided between the recess 2*a* and the protruding portion 1*a* of the sand core so as to positively introduce the molten metal into the clearance S2 to provide the flash therein. Therefore, after casting operation, flash removing operation is required. Further, because of the positive formation of the flash, the molten metal pressure is applied to the entire end surface 1*d* of the sand core 1. Because the molten metal pressure is always applied to the rear end surface 1*f* of the sand core 1, the core prints 1*b* are required for preventing the sand core from being deviated in the axial direction of the cylinder during casting. Consequently, the above described machining and plugging are required. The second embodiment pertains to an improvement on these aspects.

Figure 7:
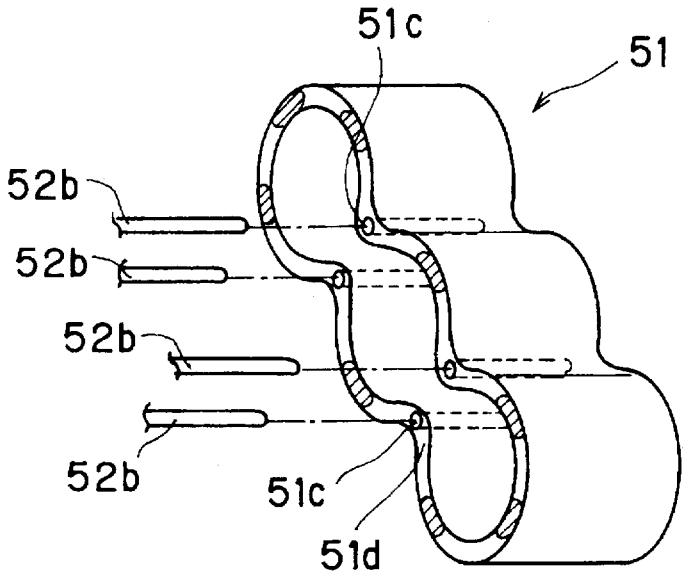
FIG. 7 is a perspective view showing a sand core according to a second embodiment of this invention for forming a water jacket, the core being used for casting a closed deck type cylinder block.
Figure 8:
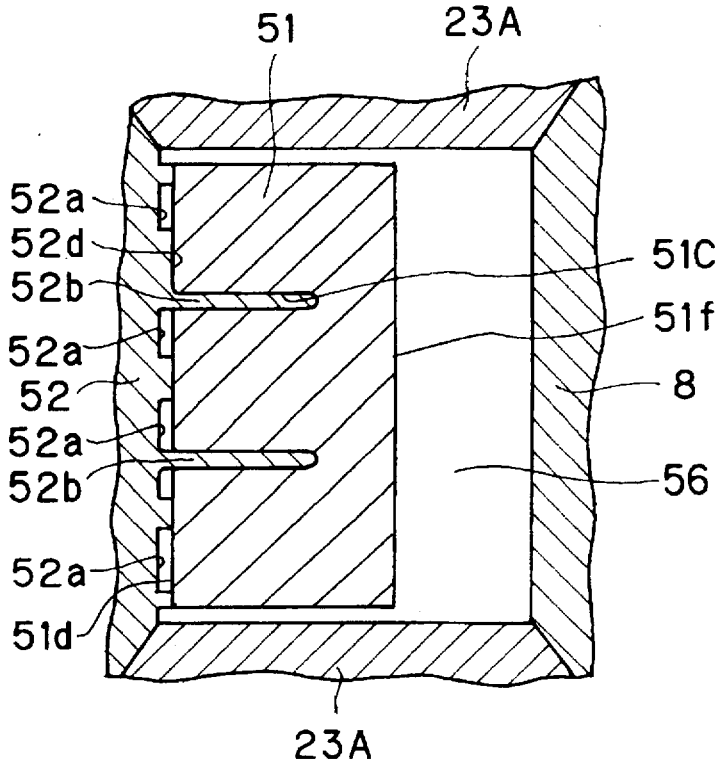
FIG. 8 is a cross-sectional view showing the sand core of FIG. 7 and a metal mold including a slide core in a casting device according to the second embodiment for casting the closed deck type cylinder block.

As shown in FIGS. 7 and 8, a sand core 51 in the second embodiment is similar to the sand core 1 of the first embodiment except that an end face 51*d* facing a slide core 52 is of a flat plane without any protruding portions (1*a* in FIG. 1), and core prints (1*b* in FIG. 1) are not provided at the periphery of the sand core 51. An end face 52*d* of the slide core 52 facing the top deck end 51*d* of the sand core 51 is formed with recesses 52*a* so as to form bridge portions. The end face 52*d* other than the recesses 52*a* will be in intimate contact with the flat end face 51*d* of the sand core 51 so as to form windows of the water jacket end. In other words, in the second embodiment, it is unnecessary to provide the protruding portions 1*a* at the end face 51*d* of the sand core, but the end face 51*d* is of a simple planner arrangement. Incidentally, the end face 52*d* other than the recessed portions 52*a* of the slide core 52 may be referred to as protruding portions. Further, in FIG. 7, the bridge portions will be provided after casting at hatching portions delineated on the end face 51*d*.

Similar to the first embodiment, a pair of slide cores 52,52 are provided besides the movable die 12, and the above described first and second slide cores 22,22 and 23A, 23A are movably disposed around the slide cores 52, 52. The stationary die 8, the slide cores 52, 52, the fist and second slide cores 22,22, 23A, 23A and the movable die 12 will form an outer contour of the V-bank type 6 cylinder engine block. Each of the slide cores 52 is provided with a cylindrical projection for supporting the cylinder liner 5. Each slide core 52 also provides holding projections **52*b* extending in the axial direction of the cylinder liner 5 and protruding from the end face 52*d* toward a mold cavity 56. Shape of the holding projections 52*b* and the holding bores 51*c*** are identical with those of the first embodiment.

The second slide cores 23A,23A are not formed with supporting recess (**23*a* in the first embodiment) because core prints are not provided at the sand core 51. Thus, in the closing state of the metal mold, the front end face 51*d* of the sand core 51 is set in intimate contact with the end face 52*d* of the slide core 52. With this state, the sand core 51 is stably set in the mold cavity 56 by the engagement between the holding projections 52*b* and the holding bores 51*c***.

When filling the molten metal into the mold cavity 56, advancing limit position of the sand core 51 in the axial direction of the cylinder liner 5 can be defined by the abutment between the end face **51*d* of the sand core 51 and the end face 52*d* of the slide core 52. On the other hand, the rearmost retracting limit position of the sand core in the axial direction is not defined, but large space is provided behind the rear end of the sand core 51 as shown in FIG. 8. However, because of the difference in molten metal pressures between the front end face 51*d* and the rear end face 51*f* of the sand core 51, the sand core 51 is urged toward the face 52*d* of the slide core 52. That is, the molten metal pressure force F1 applied to the front end face 51*d* of the sand core 51 is $F1=P\times(a-b)$, whereas the molten metal pressure F2 applied to the rear end face 51*f* of the sand core 51 is $F2=P\times a$, where "P" is the casting pressure, "a" is an area of the front end face 51*d*(or rear end face 51*f*) of the sand core 51, and "b" is the contacting area between the front end face 51*d* and the end face 52*d* of the slide core 52**. Accordingly, F2 is greater than F1.

In this way, the sand core 51 is urged toward the advanced limit position because of the difference between F1 and F2, and consequently, positioning of the sand core 51 in the axial direction of the cylinder liner can be made. As a result, the core prints (**1*b* in FIG. 1**) can be eliminated.

Upon casting, the molten metal is entered into the recessed portions **52*a* to form the bridge portions, whereas windows of the water jacket can be formed at the contacting portions between the front end 51*d* of the sand core 51 and the end face 52*d* of the slide core 52. After casting, the casted product is removed from the metal mold. In this case, problem of residual sand within the metal mold does not occur because the end face of the sand core does not have protruding portions (2*a* of FIG. 1) contrary to the first embodiment, but the end face 51*d*** is of a planner arrangement.

Similar to the first embodiment, according to the second embodiment, the engagement between the holding projections **52*b* and the holding bores 51*c* stably holds the sand core 51 within the mold cavity 56. However, contrary to the first embodiment, the entire flat front face 51*d* of the sand core 51 can be contacted with the slide core 52 since it is unnecessary to positively provide the flash for the purpose of removing the residual sand, and as a result, contacting areas with the molten metal are different between the front end face 51*d* and the rear end face 51*f* of the sand core 51, to thus urgedly position the sand core 51 to the advanced limit position. Consequently, the core prints can be dispensed with, to thereby eliminating the above described machining required in the first embodiment. Further, in the second embodiment, the sand core 51 per se can be easily produced because the end face 51*d* of the sand core 51** is of a planner arrangement without protruding portions. The flat or planner arrangement is also advantageous in that the problem of release of sand can be reduced or minimized.

While the invention has been described in detail and with reference to the specific embodiments thereof, it would be apparent to those skilled in the art that various changes and modifications may be made therein without departing from the spirit and scope of the invention. For example, in the above described embodiments, four holding projections **2*b* (52*b*) and corresponding four holding bores 1*c* (51c) are provided. However, the number can be not less than 2 as far as the sand core 1 or 51** can be properly held in the metal mold. Further, the die for accommodating the sand core can be any type of die as far as the drop of the sand core due to its own weight is avoidable.

Further, the depicted embodiments concern the production of the closed deck type V array six cylinder engine block. However, the invention can be applied to a closed deck type in-line engine block such as four cylinder in line engine block and six cylinder in line engine block.

Figure 9:
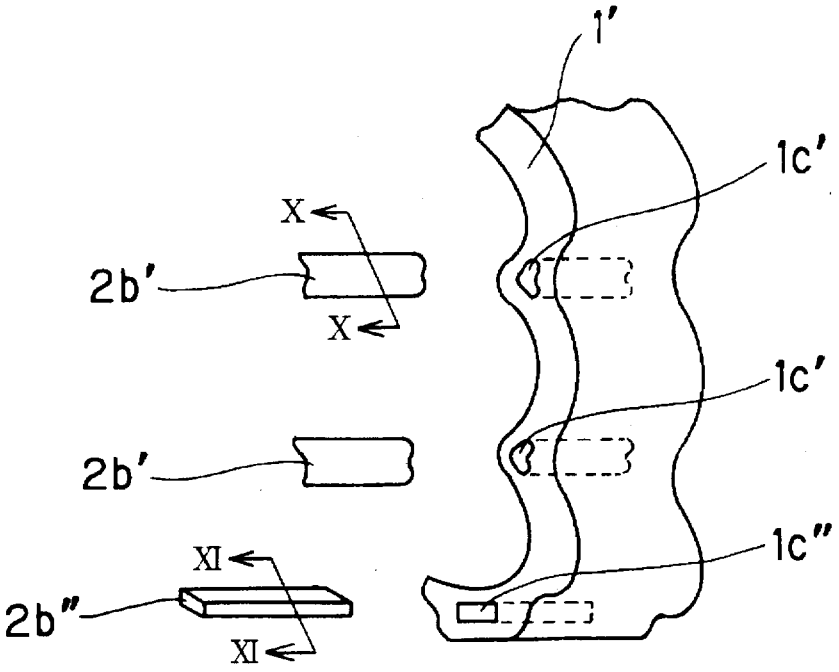
FIG. 9 is a partial perspective view showing several modifications to the holding bore and a holding protrusion to be inserted thereinto.
Figure 10:
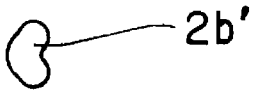
FIG. 10 is a cross-sectional view taken along the line X—X of FIG. 9.
Figure 11:
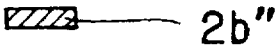
FIG. 11 is a cross-sectional view taken along the line XI—XI of FIG. 9.
Figure 12:
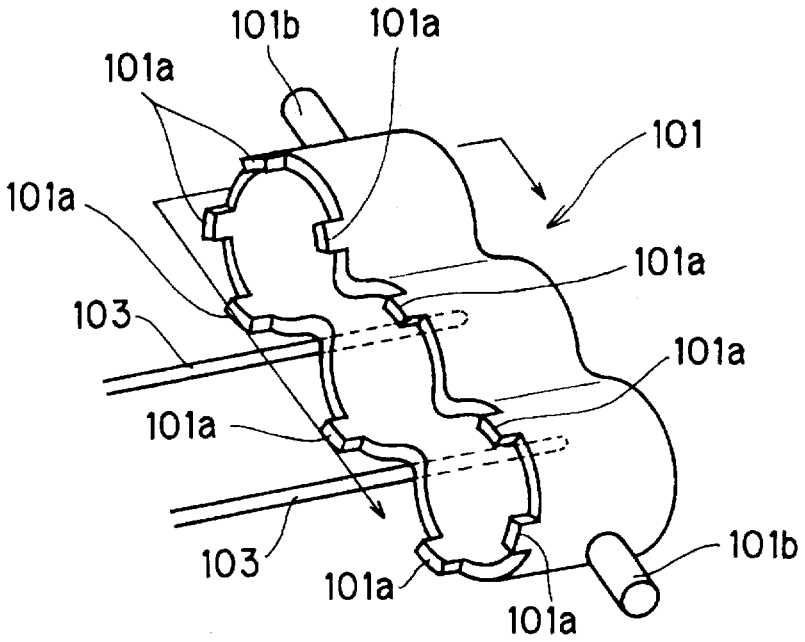
FIG. 12 PRIOR ART
FIG. 12 is a perspective view showing a conventional sand core to be used for casting a closed deck type cylinder block.
Figure 13:
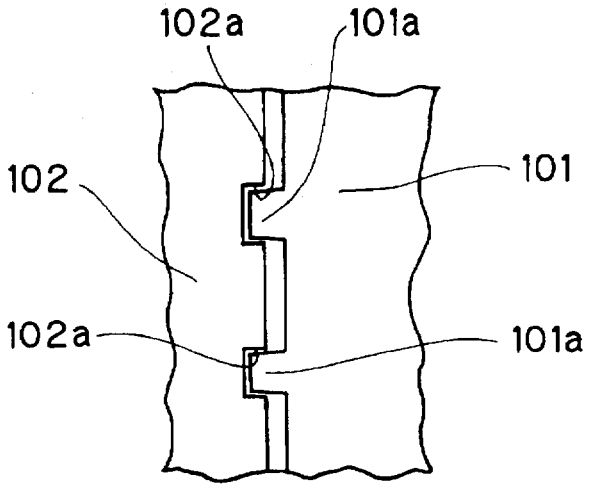
FIG. 13 PRIOR ART
FIG. 13 is a schematic cross-sectional view showing a part of a slide core and the conventional sand core held by the slide core.

Further, the cross-sectional configuration of the holding projections **2*b* or 52*b* and corresponding holding bores 1*c* or 51*c* is not limited to the circular shape, but generally triangular shape projections 2*b*' and bores 1*c*' shown in FIGS. 9 and 10 and rectangular shape projections 2*b*" and bores 1*c*" shown in FIGS. 9 and 11 are also available. Furthermore, the depth of the holding bores 1*c* can be varied dependent on the kind and size of the cylinder block and a posture of the sand core during casting as far as the sand core can be properly maintained in the metal mold. Furthermore, position of the holding bores 1*c* or 51*c* is not limited to the area 1*e* adjacent to the neighboring cylinders, but can be positioned other than the neighboring cylinders such as an area around 1*c*" in FIG. 9**.

What is claimed is:

1. A device for producing a closed deck type cylinder block and a sand core to be used in the device, the closed deck type cylinder block having a top deck and being formed with a water jacket surrounding a plurality of juxtaposedly arrayed cylinder liners, the water jacket having an upper end partly open at the top deck for forming windows and partly closed by bridge portions, the device comprising:

a metal mold defining therein a mold cavity; and a holding projection integrally extending from the metal mold toward the mold cavity in an axial direction of the cylinder liner; and the sand core being formed with complementary holding bore which allows the holding projection to extend thereinto for holding the sand core at a predetermined position within the mold cavity during casting operation.

2. The device and the sand core as claimed in claim 1, wherein the metal mold comprises a slide core having an end face defining a part of the mold cavity, the end face being formed with a plurality of recesses;

and wherein the sand core has a top deck end face formed with protrusions each engageable with each recess of the slide core, a space being provided between the recess and the protrusion for positively providing a flash at the space.

3. The device and the sand core as claimed in claim 2, wherein the sand core comprising:

a wall portion having the top deck end face and an outer peripheral surface, the wall portion having a shape identical with the water jacket; and core prints extending from the outer peripheral surface, and wherein the metal mold further comprising a pair of slide cores formed with engaging recesses for engaging with the core prints so as to prevent the sand core from being deviated in the axial direction of the cylinder liner.

4. The device and the sand core as claimed in claim 3, wherein the holding projection has a tapered shape having an outer diameter gradually reduced toward its tip, and wherein the holding bore has a complementary tapered shape for providing a draft.

5. The device and the sand core as claimed in claim 4, wherein the wall of the sand core has an uneven thickness around the cylinders, a thickness of a portion of the wall adjacent neighboring cylinders being greater than a remaining portion of the wall to provide a thick wall portion, the holding bore being formed in the thick wall portion.

6. The device and the sand core as claimed in claim 1, wherein the metal mold comprises a slide core having an end face defining a part of the mold cavity, the end face being formed with a plurality of recesses;

and wherein the sand core has a planner top deck end face in intimate contact with the end face of the slide core at portions other than the plurality of recesses during casting operation, the contacting area between the planner top deck end face of the sand core and the end face of the slide core forming the windows.

7. The device and the sand core as claimed in claim 6, wherein the holding projection has a tapered shape having an outer diameter gradually reduced toward its tip, and wherein the holding bore has a complementary tapered shape for providing a draft.

8. The device and the sand core as claimed in claim 7, wherein the sand core comprises a wall having a shape identical with the water jacket, the wall of the sand core having an uneven thickness around the cylinders, a thickness of a portion of the wall adjacent neighboring cylinders being greater than a remaining portion of the wall to provide a thick wall portion, the holding bore being formed in the thick wall portion.

* * * * *